US007127986B2

(12) United States Patent
Daniel et al.

(10) Patent No.: US 7,127,986 B2
(45) Date of Patent: Oct. 31, 2006

(54) LATERALLY DISPLACEABLE GUIDE TRACK FOR A BULK MATERIAL BALER APPARATUS AND METHOD

(75) Inventors: Bart Daniel, Kennesaw, GA (US); Scott Shepard, Lubbock, TX (US); Glenn Ellison, Lubbock, TX (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 10/926,447

(22) Filed: Aug. 25, 2004

(65) Prior Publication Data

US 2006/0042478 A1 Mar. 2, 2006

(51) Int. Cl.
*B65B 13/04* (2006.01)

(52) U.S. Cl. ..... 100/26; 100/3; 53/589

(58) Field of Classification Search ..... 100/3, 100/8, 25, 26; 53/589
See application file for complete search history.

(56) References Cited

U.S. PATENT DOCUMENTS

| | | | | |
|---|---|---|---|---|
| 3,720,158 | A | 3/1973 | Sauer et al. | |
| 4,043,261 | A | 8/1977 | Mae | 100/26 |
| 4,561,349 | A | 12/1985 | Grenon | 100/26 |
| 4,611,534 | A | 9/1986 | Kudlicka et al. | 100/26 |
| 4,625,635 | A | 12/1986 | Lewis | 100/3 |
| 5,546,855 | A * | 8/1996 | Van Doorn et al. | 100/11 |
| 5,890,423 | A | 4/1999 | Lih | 100/26 |
| 6,415,712 | B1 | 7/2002 | Helland et al. | 100/26 |
| 6,516,592 | B1 | 2/2003 | Kimmerle | 53/589 |
| 6,553,900 | B1 * | 4/2003 | Daniel et al. | 100/26 |
| 6,571,691 | B1 | 6/2003 | Jones | 100/26 |
| 6,637,324 | B1 | 10/2003 | Stamps | 100/26 |
| 6,701,831 | B1 * | 3/2004 | Jones et al. | 100/3 |
| 6,705,214 | B1 | 3/2004 | Stamps | |

OTHER PUBLICATIONS

Communication Relating to the Results of the Partial International Search dated Jan. 12, 2006.

* cited by examiner

*Primary Examiner*—Derris H. Banks
*Assistant Examiner*—Jimmy T. Nguyen
(74) *Attorney, Agent, or Firm*—Husch & Eppenberger, LLC; Grant D. Kang

(57) ABSTRACT

A laterally displaceable guide track for a bale binding apparatus includes a carriage with a guide track portion mounted on it with a hinge. The guide track portion has an engaged position and a disengaged position. The engaged position is aligned with at least one other guide track portion to define a bale loop plane, and the disengaged position is out of the bale loop plane. The mount allows the guide track portion to be moved between the engaged position and the disengaged position. The disengaged position allows the carriage to be withdrawn from a baling station for ejection of a finished bale.

23 Claims, 21 Drawing Sheets

LATERALLY DISPLACEABLE GUIDE TRACK FOR A BULK MATERIAL BALER APPARATUS AND METHOD

CROSS-REFERENCE TO RELATED APPLICATIONS

None.

STATEMENT REGARDING FEDERALLY SPONSORED RESEARCH OR DEVELOPMENT

Not Applicable.

APPENDIX

Not Applicable.

BACKGROUND OF THE INVENTION

1. Field of the Invention

The present invention is in the field of automated bale binding apparatuses engageable with bulk material compressors, in particular down presses.

2. Related Art

Baling of bulk material such as cotton is achieved by a compression apparatus, usually hydraulic, that compresses a volume of bulk material into a preconfigured bale shape and size. While still compressed, a bulk material bale binding apparatus engages the volume of compressed material at a baling station and binds it with wire or metal or plastic strap.

The binding wire or strap is placed around a compressed volume of material in a baling station by feeding the wire or strap through a guide track that circumscribes the volume of material to be baled and guides the wire or strap into a loop around the bale. The loop is on a single plane, typically transverse to a long axis of the bale. Thereafter the wire or strap is released from the track, tightened around the material to be baled and fastened or knotted. These procedures are described in detail in prior art such as U.S. Pat. Nos. 6,637,324 and 6,553,900, which are incorporated by reference herein.

It is in the nature of the compression apparatus that the circumscribing guide track must be disengageable at least in part, so that the compression machinery can eject a finished bale and compress a new bale. Prior art devices have achieved the disengagement of a portion of guide track either by swinging it upwards and away from the baling station, or sliding it outward from the baling station. These prior art solutions are typified by a fixed guide track portion and a moveable guide track portion. Both of these portions always remained within the plane of the bale loop, whether disengaged or not.

One form of bale compression apparatus is called a down press. Down presses are completely above a floor level and generally comprised of a first and second compression box for receiving a volume of bulk material to be baled. A first box is typically filled with loose material while a second box is simultaneously compressed and baled. Filling a box with loose material happens at a first position engaged with a tramper, which fills the box. Bale binding occurs at a second position having a vertically oriented hydraulic press for compressing the volume of bulk material. Binding occurs at the compression station. The boxes are transposed from the filler station to the compression and binding station by rotation around a central column. The boxes, press and central column are supported by a frame comprised of two end columns and a support lintel. Any automated bale binding apparatus used to bind the compressed volumes of bulk material must withdraw to a position outside the circumference of the rotation of the two boxes around the center column. Withdrawal of binding equipment in a direction perpendicular to a plane defined by the support frame would require moving the apparatus an impractical distance, and would be blocked by other equipment such as supply lines for hydraulics. Accordingly, prior art disengagement apparatuses that disengage guide track portions within the same plane as the bale loop are impractical for use with down presses, because the bale loop plane is perpendicular to the support frame.

Accordingly, there is a need in the art for automated bale binding equipment for use with down presses that disengages in a direction parallel with the frame of the down press and in a direction nonparallel to the bale loop plane. Concomitantly, there is a need for guide track components that are disengageable in a manner allowing such a lateral disengagement of the binding apparatus from the baling station. Additionally, there is a continuing need in the art for durability, compact size, and economy.

SUMMARY OF THE INVENTION

It is in view of the above problems that the present invention was developed. The present invention is a disengageable guide track for use with the laterally displaceable binding apparatus for use with a bulk material baling down press.

A laterally displaceable guide track for a bale binding apparatus includes a carriage with a guide track portion mounted on it with a hinge. The guide track portion has an engaged position and a disengaged position. The engaged position is aligned with at least one other guide track portion to define a bale loop plane, and the disengaged position is out of the bale loop plane. The mount allows the guide track portion to be moved between the engaged position and the disengaged position. The disengaged position allows the carriage to be withdrawn from a baling station for ejection of a finished bale.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE PREFERRED EMBODIMENTS

Referring to the accompanying drawings in which like reference numbers indicate like elements.

Figure 1:
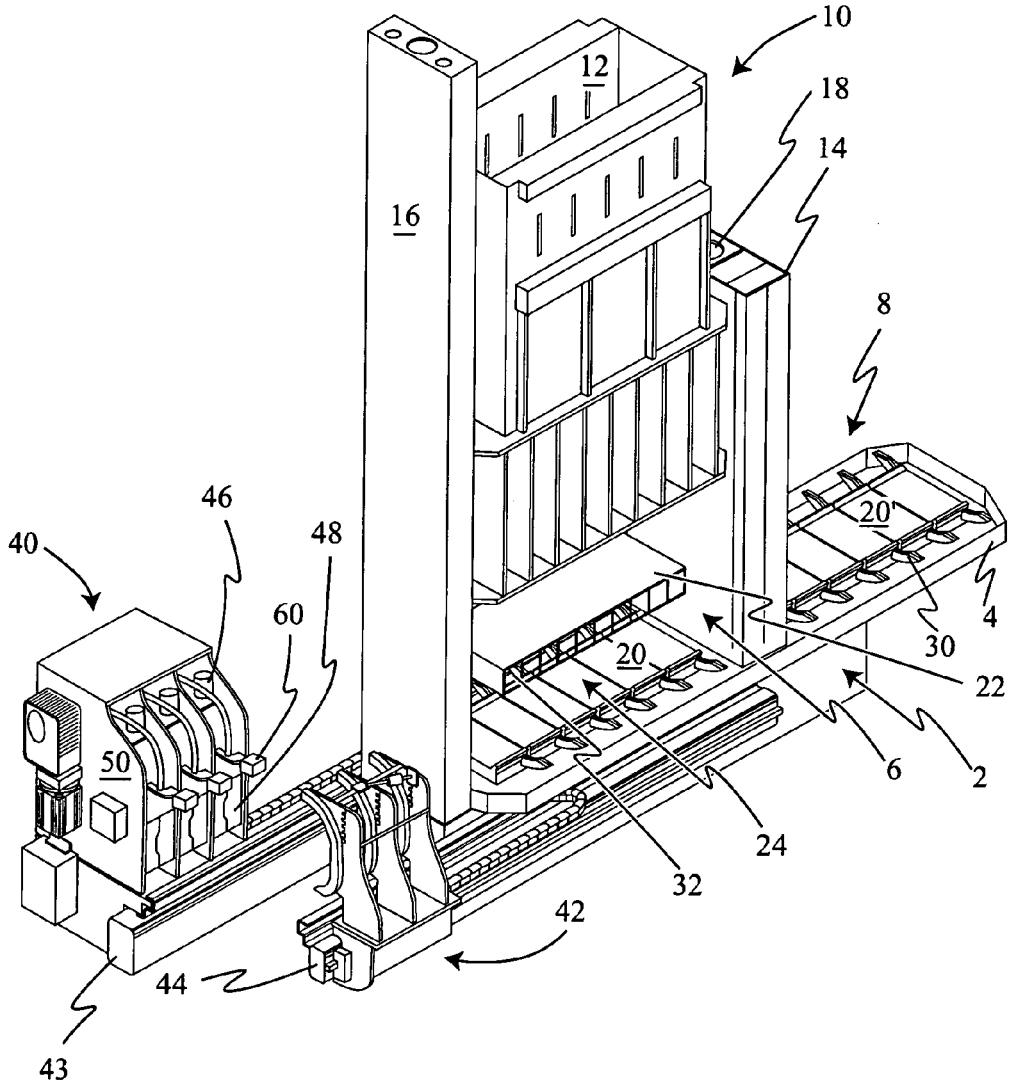
FIG. 1 is a perspective view of a down press, with a bale binder apparatus of the present invention disengaged.

FIG. 1 shows that the down press 10 is comprised generally of a first compression box 12 on a baling side 6 and a second compression box loading side 8. A second compression box is omitted for clarity on the loading side 8. While a first bale is being compressed and bound in baling station 24, oriented on the near side of the perspective image in FIG. 1, a second compression box is being loaded with cotton at the loading side 8. Compression boxes 12 are moved from the loading size 8 to the baling side 6 by rotation around a vertical axis comprised of central piston 18 within central column 14. That is, the compression box 12 and central column 14 rotate so that the compression box 12 moves into the baling portion 6 with a load of loose cotton, there to be compressed from above by hydraulics (not show). Bed 4 rotates also.

The components of the down press that remain stationary are base 2 and end column 16. An opposite end column is omitted for clarity.

On the baling side 6 of the down press a baling station 24 is formed. The baling station floor is one of the lower platens 20 or 20'. The lower platen 20 receives, restrains and resists against the compression of a volume of bulk material being down pressed onto it from above. The cotton is pressed down and the top side of the baling station is formed by upper platen 22. Upper platen 22 is connected to the vertically oriented downwards moving hydraulics (not shown) that move through the compression box 12.

After a volume of bulk material has been compressed and bound with wire or strap, it is ejected from baling station 24. Simultaneously with the bale binding operation, the other compression box has been loaded at loading side 8. Thereafter, the down press rotates again and through its rotation transposes the position of the now empty compression box 12 and the other compression box (not shown), now loaded with uncompressed cotton. Clearly, in order to operate, there must be a clear path of 360 degrees around center axis 18 with a radius equal to the width of a compression box 12 and the bed 4. Accordingly, any binding equipment must be withdrawn beyond that radius. The prior art technique of removing binding equipment outward or upward parallel to the bale loops is impractical. The shortest removal distance is parallel to a radius of the rotation.

In order to do this, the binding apparatus of the present invention comprised generally of a first driver carriage 40 and a second return carriage 42. Each carriage is comprised of an assembly of mounting brackets 50, generally vertically oriented. Driver carriage 40 rides laterally on a rail 43. Likewise, return carriage 42 rides on rail 44. The rails are oriented to be parallel with the long side of the compression box 12 and the bed 4. The first carriage 40 also carries with it multiple wire or strap drivers 46 and multiple wire knotters or strap fasteners 48. In the depicted embodiment, carriage 40 carries three wire drivers 46 and three knotters 48. There are six baling wires to be installed on a standard bale of cotton. Accordingly, in addition to translating along rails 43 and 44 to withdraw from the down press 10, the bale binding apparatus of the present invention also translates between a first three binding wire positions and a second three binding wire positions.

Guide rails work in a known fashion, such as described in U.S. Pat. No. 6,637,324 to Stamps and U.S. Pat. No. 6,553,900 to Daniel, incorporated by reference herein. Essentially, two longitudinal halves of any guide track portion are biased together by springs. They have a longitudinal channel therein for receipt and guidance of a progressing bale wire. The various guide track portions are oriented around a baling station, and consequently a bale in order to complete a loop of baling wire around the volume of bulk material to be baled. After a driver drives the wire through the complete guide track, a tensioning mechanism retracts the baling wire or strap from the guide track and tightens it around the bulk material. The tension placed on the bale wire or strap in a radially inward direction is sufficient to overcome the spring bias holding the lateral guide sections together, thereby releasing the wire or strap from the guide track for it to be tensioned against the bale, and fastened.

The overall guide track of the present invention is comprised of lower guide track portions 30, which reside in the lower platens 20 and 20', and upper guide track portions 32 which reside in the upper platen 22 and the guide track portions that form components of the carriages 40 and 42.

All of these components are on a single bale loop plane that is perpendicular to the long axis of the bale.

Figure 2:
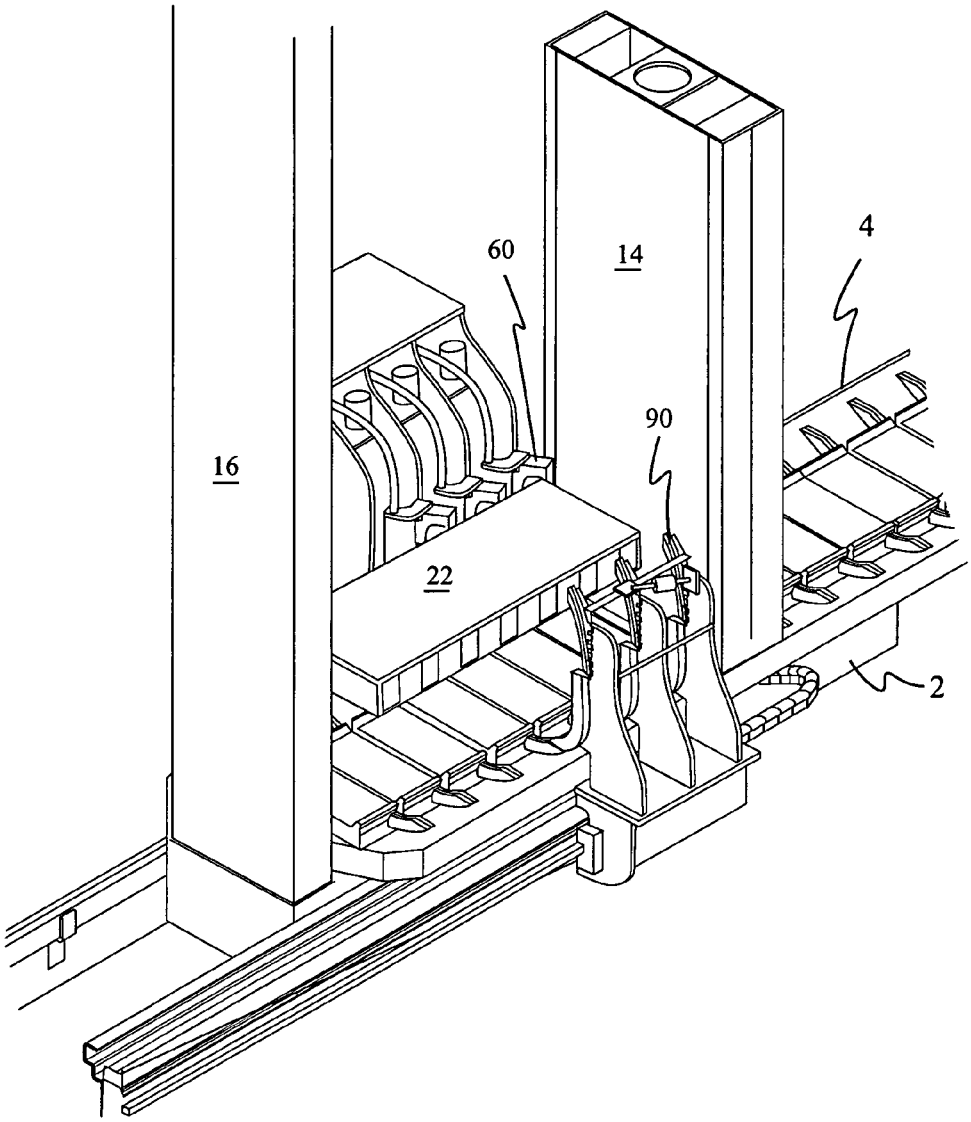
FIG. 2 is a perspective view of a down press with a bale binder apparatus of the present invention with the guide track carriages in place and disengaged.

FIG. 2 shows the bale binding apparatus of the present invention in its inward position, with its guide tracks disengaged. In FIG. 2, end column 16 and center column 14 are depicted along with bed 4 and stand 2 of the down packer. The compression box 12 has been omitted for clarity. Upper platen 22 appears, but the mechanisms that support it in the depicted compressed and ready to bale position i.e., the hydraulic press, has been omitted for clarity.

Figure 3:
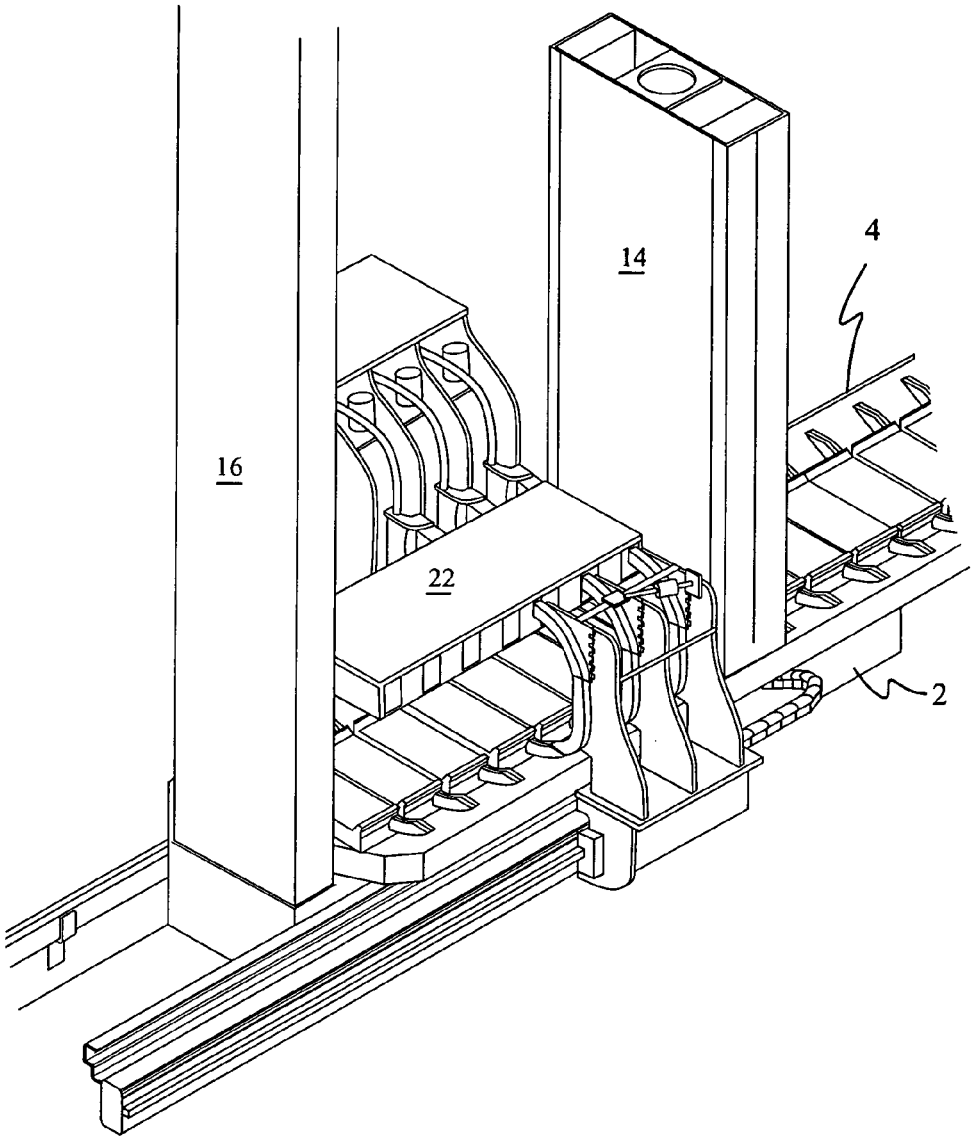
FIG. 3 is a perspective view of a down press with the guide track carriages in place and the guide track portions engaged.

It is apparent from FIGS. 2 and 3, and particularly top views 4 and 5 that the width of the upper platen 22 is less than the width of the end column 16. In order for guide tracks to work properly, the gap between one guide track portion and the next must be relatively narrow, on the order of an inch or so. End column 16 is substantially more than an inch wider than upper platen 22. Accordingly, in order for the carriages 40 and 42 to translate laterally out of and back into binding position, the guide track portions mounted on the carriages 40 and 42 must have a removed position sufficiently wide for those components to clear the end column 16. The present invention is directed towards overcoming this problem in an economical, durable, fast and precise way.

Both carriages 40 and 42 have upper guide track portions 60 and 90 respectively. These guide track portions are mounted such that they have an extended, engaged position which is extended closer to one another, and narrows the gap between. This narrower space corresponds to the width of the upper platen 22, thereby bringing the upper guide track portions 60 and 90 into operative engagement and close, operative communication therewith. Upper guide track portions 60 and 90 also have a removed, disengaged position characterized by the fact that the removed position widens the gap between upper guide track portion 60 and 90 to a width sufficient to clear the end column 16 when the carriages 40 and 42 translate out of baling position, to allow the down packer to rotate.

Figure 4:
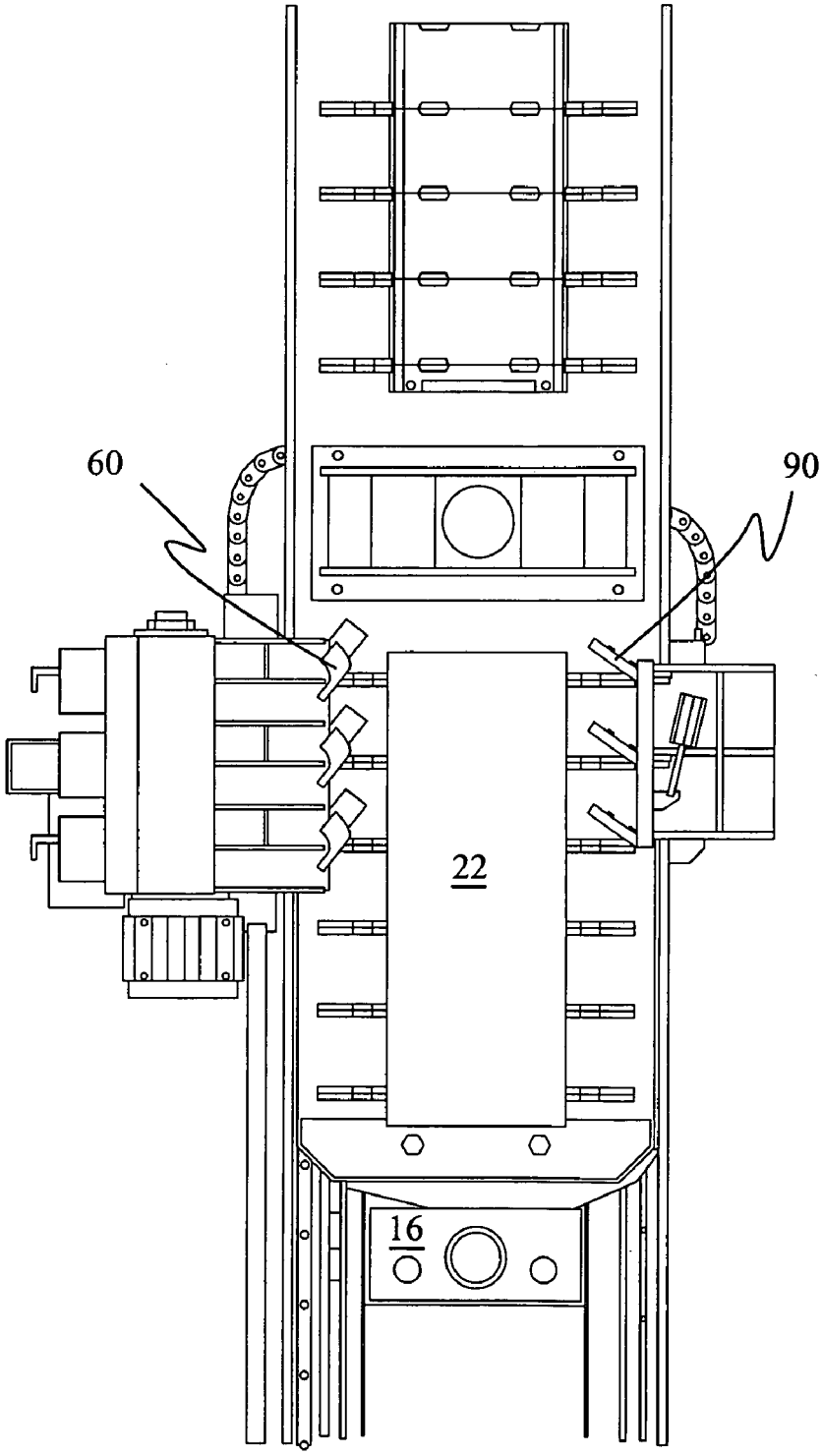
FIG. 4 is a top view of a down press with the binder carriage of the present invention in place and the guide track portions withdrawn.
Figure 5:
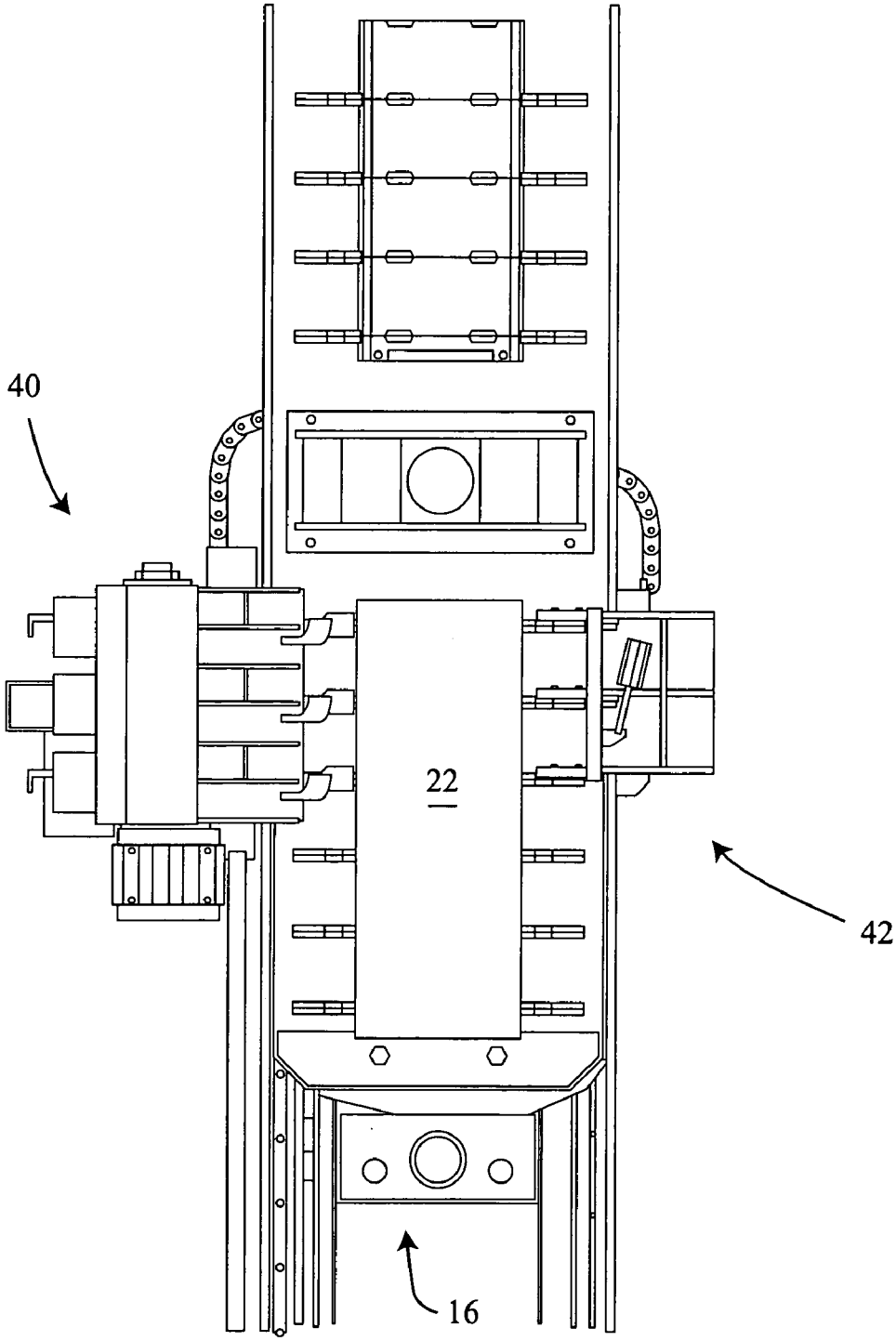
FIG. 5 is top view of a down press with the binder carriages in place and the guide track portions engaged.
Figure 6:
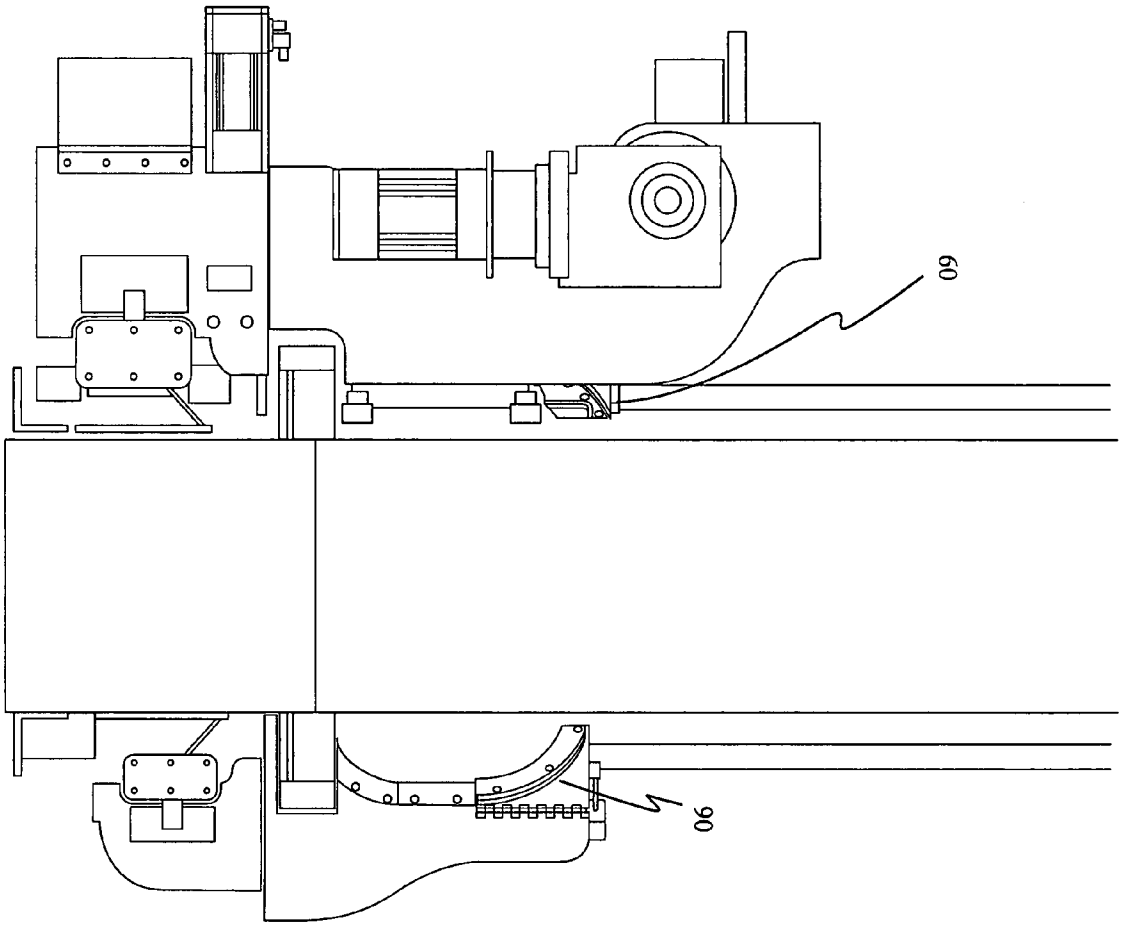
FIG. 6 is a side view of a down press with the guide track carriages of the present invention in place and the guide track portions disengaged.
Figure 7:
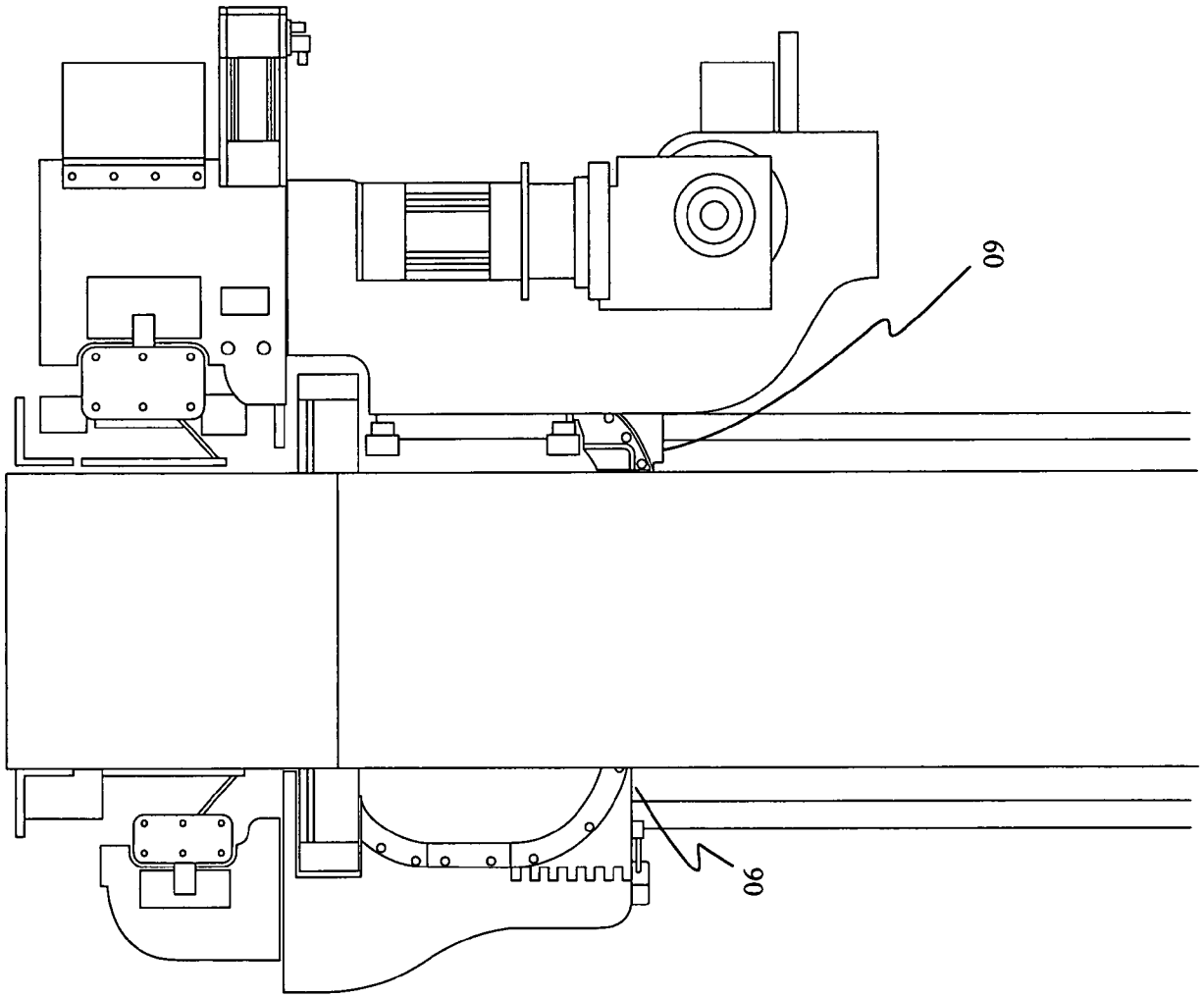
FIG. 7 is a side view of a down press with the binder carriages of the present invention in place and the guide track portions engaged.

FIGS. 2, 4, 6 (end view) all show the upper guide track portions 60 and 90 in their disengaged, removed position. FIGS. 3, 5 and 7 show the upper guide track portions 60 and 90 in their engaged, operative position. In the depicted embodiment, the mounting of the guide track portion 60 and 90 is by a hinge, oriented on a substantially vertical axis. In the depicted embodiment, the movement of the upper guide track portions 60 and 90 between their removed, disengaged and their extended, engaged positions is mediated by a piston and cylinder which in the depicted embodiment is pneumatic. Other types of linkages and linkage actuators are within the scope of the present invention.

Figure 8:
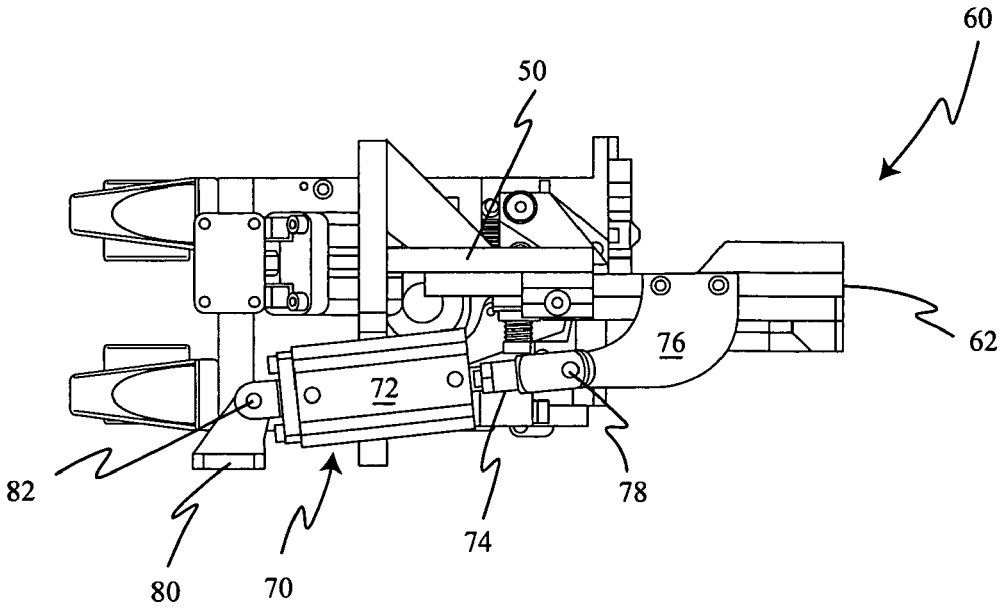
FIG. 8 is a top view of the laterally disengageable guide track portion of the present invention in an engaged position.
Figure 9:
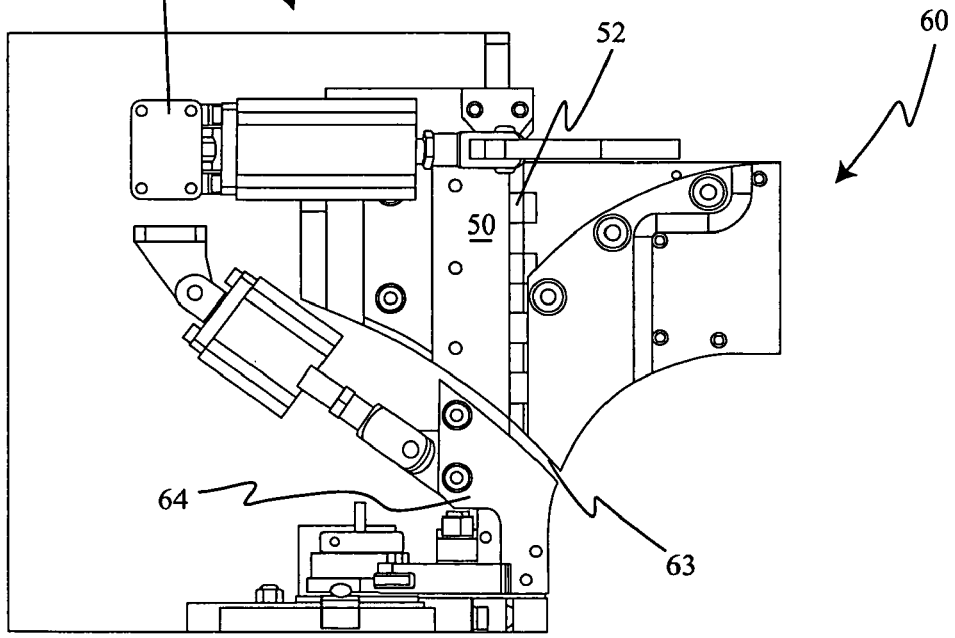
FIG. 9 is a side view of the laterally disengageable guide track portion of the present invention in an engaged position.

FIGS. 8 and 9 show the guide track portion 60 of the present invention in its engaged position. In the engaged position, the guide track portion 60 is aligned with other guide track portions in a single plane. This plane will define the bale loop. A receiving face 62 of the guide track will receive a driven bale wire or strap from another guide track portion (not shown), which in the depicted embodiment would be a top portion that would guide bale wire or strap through an upper platen of the compression apparatus. Guide track portion 60 guides the wire or strap through a 90 degree turn from a horizontal direction across the top of a bale to a downward direction where it exits guide track portion 60 at exit face 63, thereafter to be received by a next guide track portion 64, which in turn guides the wire or strap into a fastener for fastening. Both moveable guide track portion 60 and the fixed guide track portion 64 are mounted on a carriage 50. The carriage will be laterally displaceable, generally along a plane defined by the frame of the down press, in the depicted embodiment. The moveable guide track portion 60 is mounted to carriage 50 at hinge 52. It is further mounted to a moveable linkage providing for at least two positions of the moveable guide track portion 60. In the depicted embodiment, the linkage is a piston and cylinder assembly 70. The piston and cylinder assembly 70 is pneumatic in the depicted embodiment. Other drive methods may be used in alternative embodiments. A piston 74 is extendable from and retractable to cylinder 72. Cylinder 72 is hingedly attached at pivot point 82 to a further mount 80 which is fixedly attached to another portion of the carriage (not shown in FIG. 8). Piston 74 is hingedly attached to bracket 76 at pivot point 78.

Figure 10:
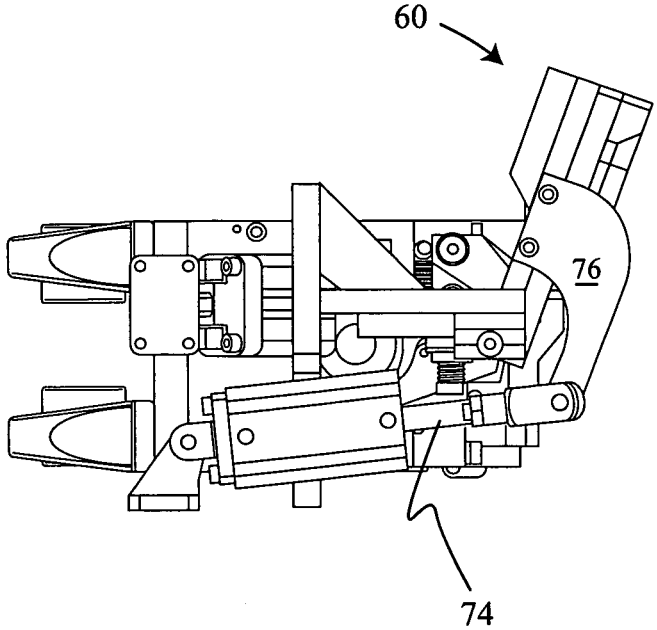
FIG. 10 is a top view of the laterally disengageable guide track portion of the present invention in a disengaged position.
Figure 11:
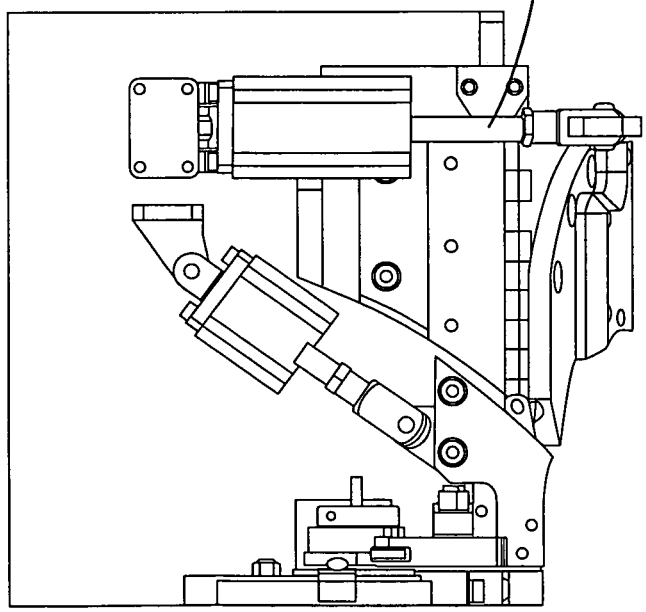
FIG. 11 is a side view of the laterally disengageable guide track portion of the present invention in a disengaged position.
Figure 12:
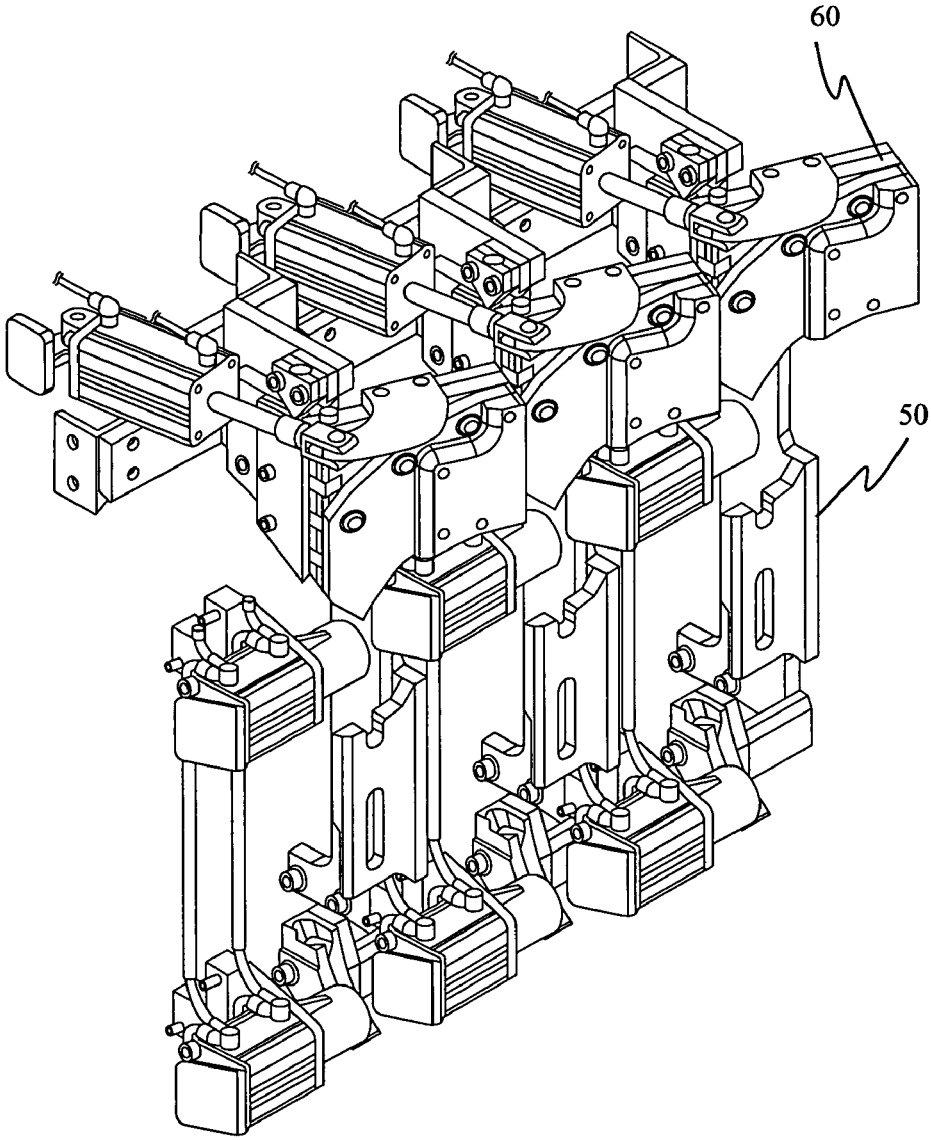
FIG. 12 is a perspective view of the driver/knotter carriage of the present invention wit the guide track portions disengaged.
Figure 13:
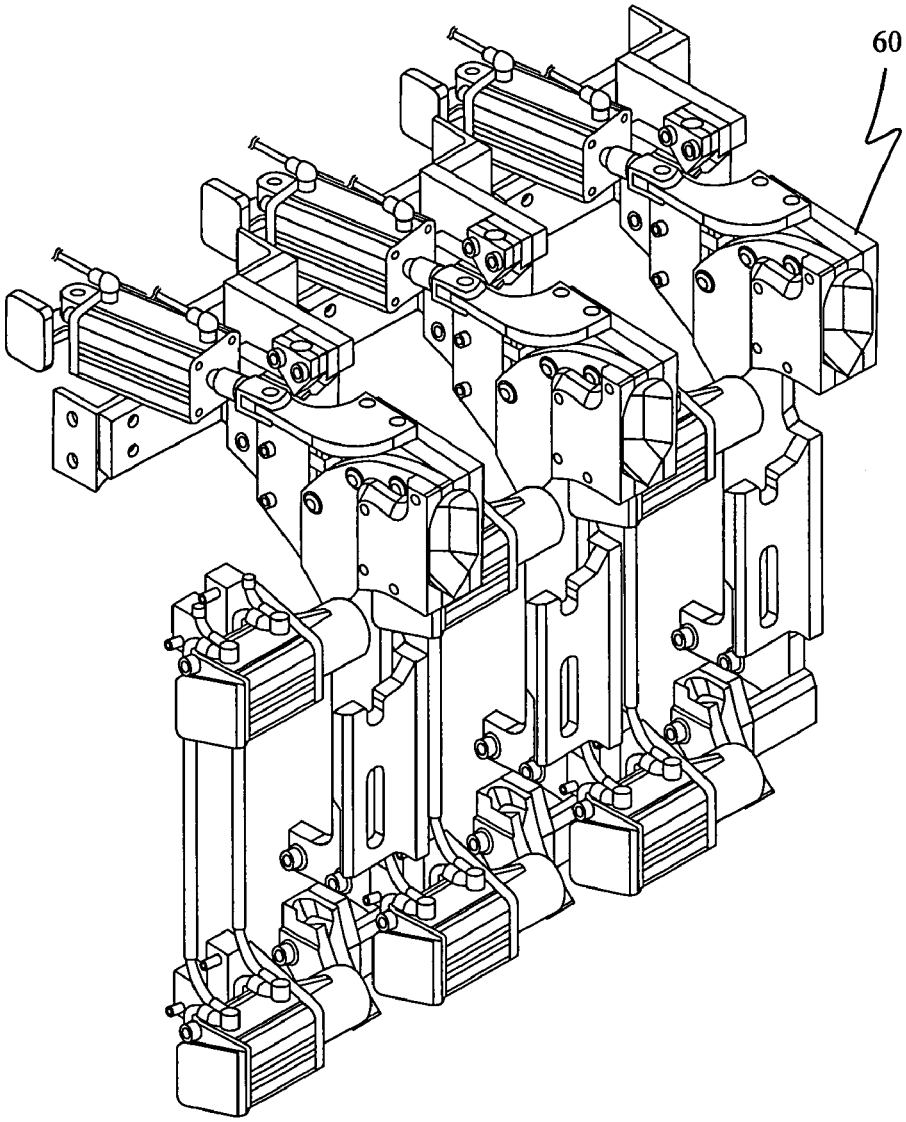
FIG. 13 is a perspective view of the driver/knotter carriage of the present invention with the guide track portions engaged.
Figure 14:
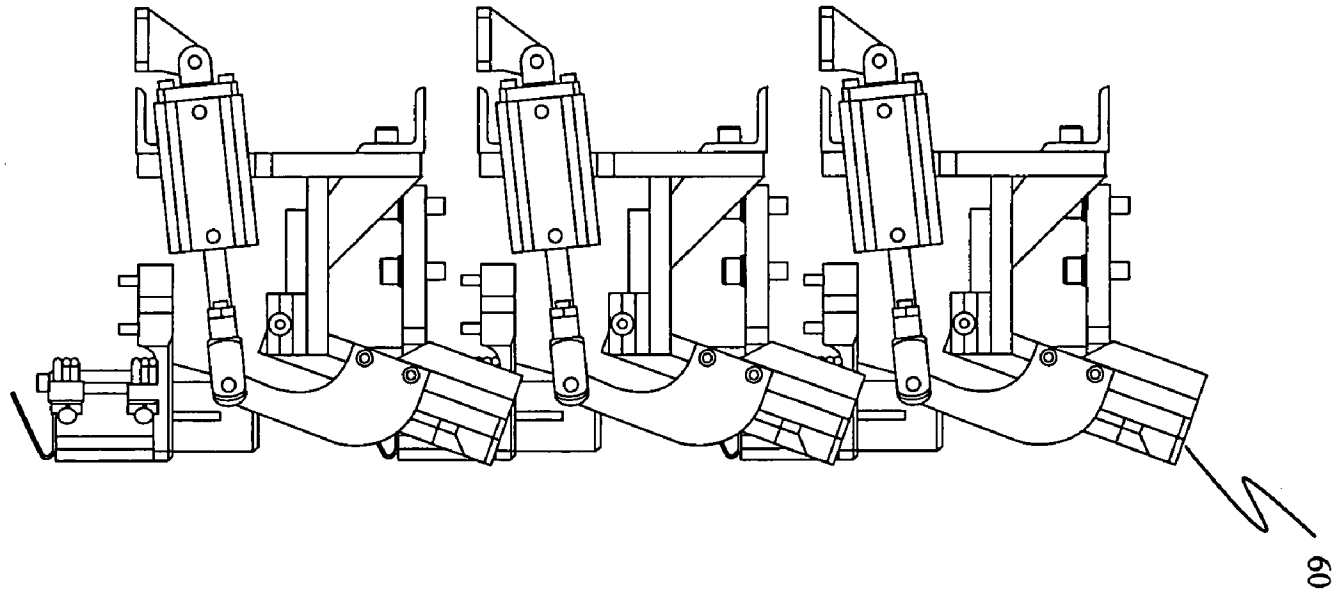
FIG. 14 is a top view of the driver/knotter carriage of the present invention with the guide track portions disengaged.
Figure 15:
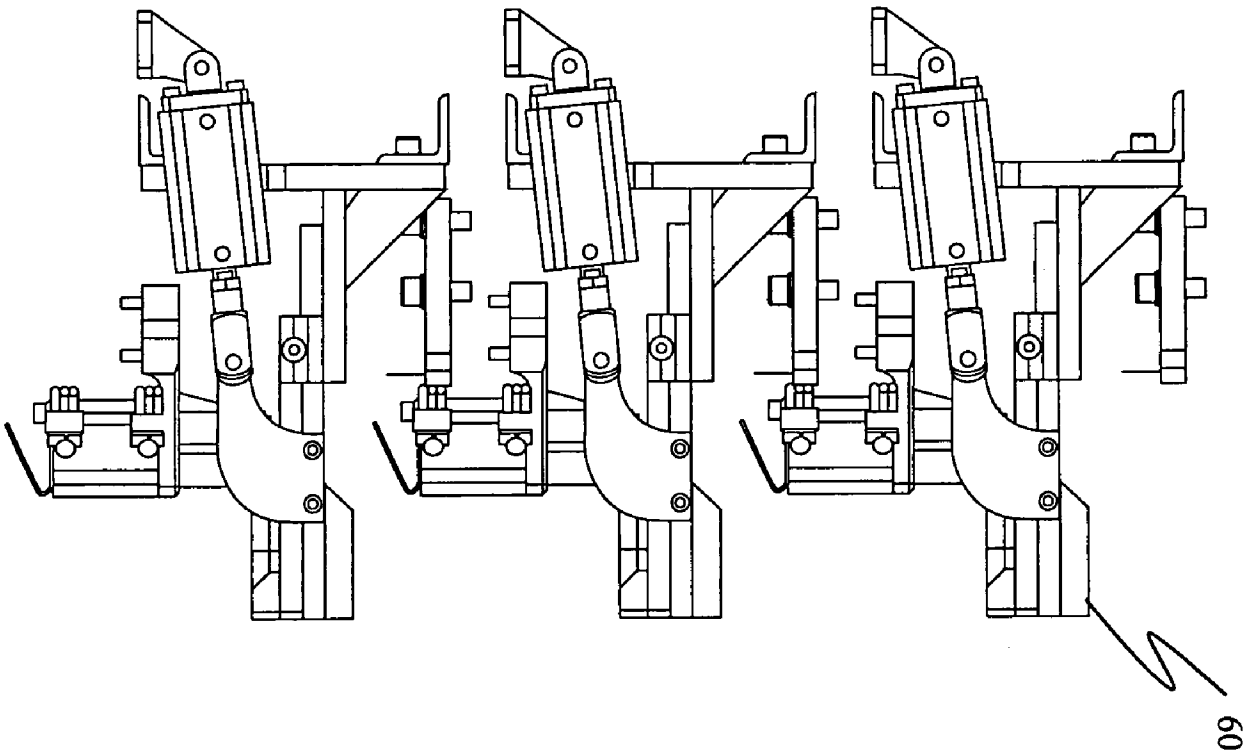
FIG. 15 is a top view of the driver/knotter carriage of the present invention with the guide track portions engaged.
Figure 16:
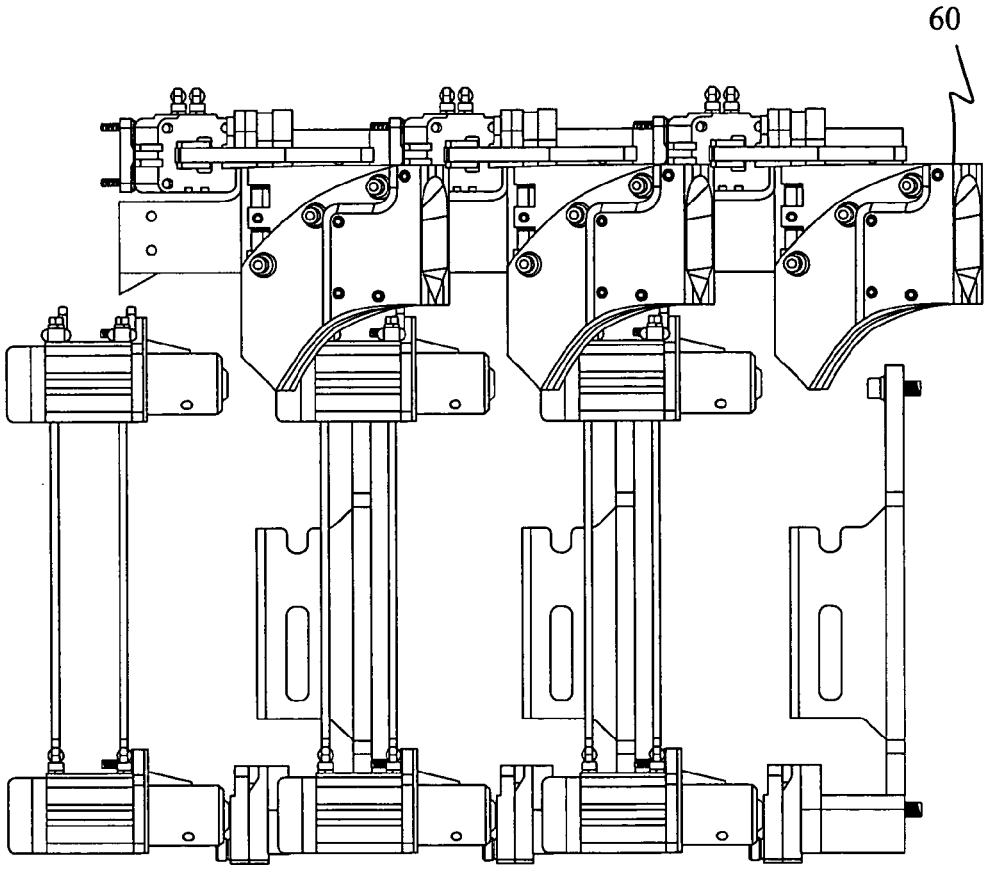
FIG. 16 is a front view of the driver/knotter carriage of the present invention with the guide track portions disengaged.
Figure 17:
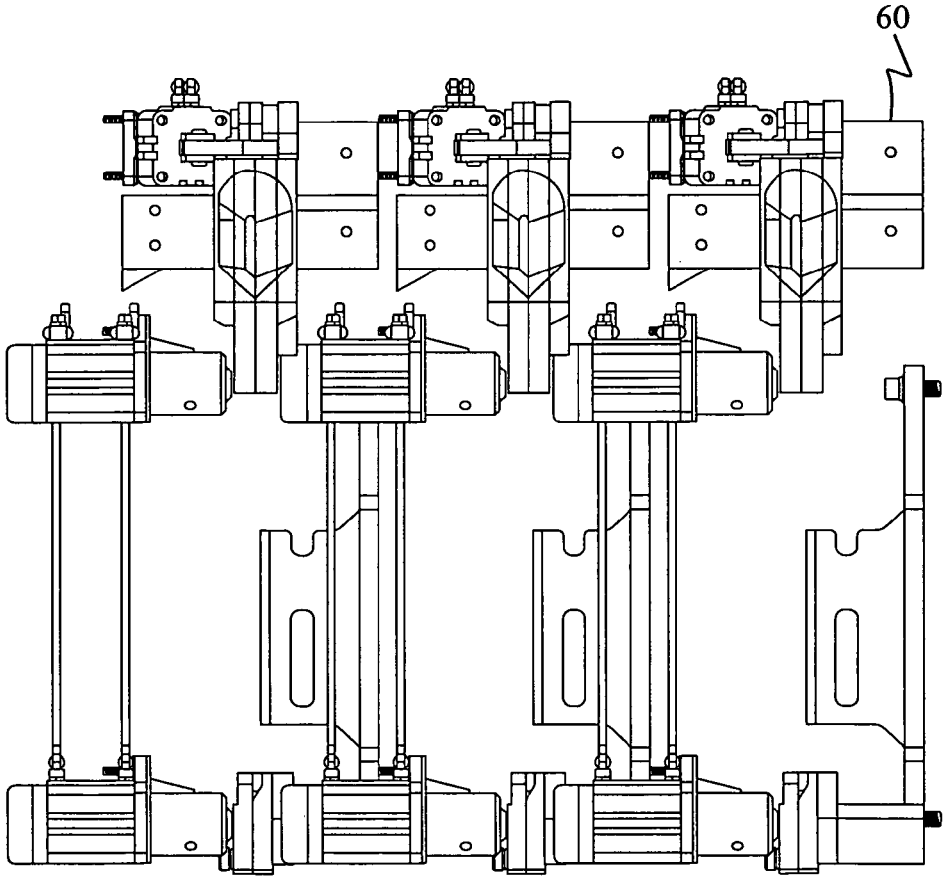
FIG. 17 is a front view of the driver/knotter portion of the present invention with the guide track portions engaged.
Figure 18:
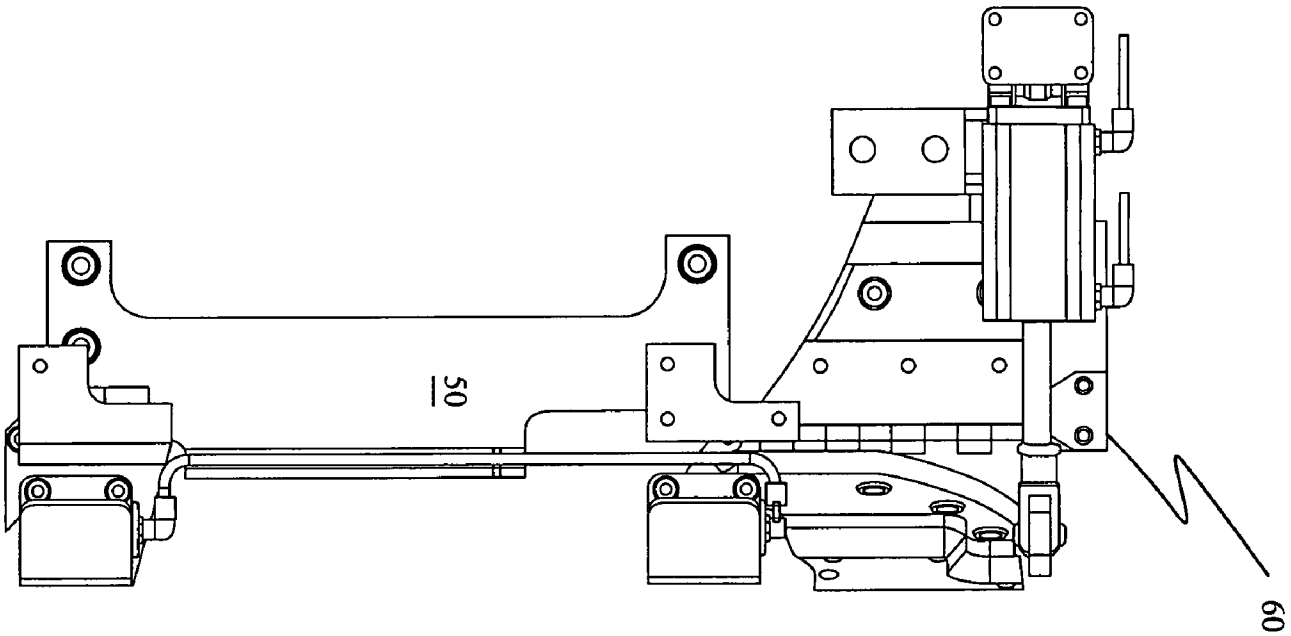
FIG. 18 is a side view of a guide track portion of the present invention mounted on its bracket in a disengaged position.
Figure 19:
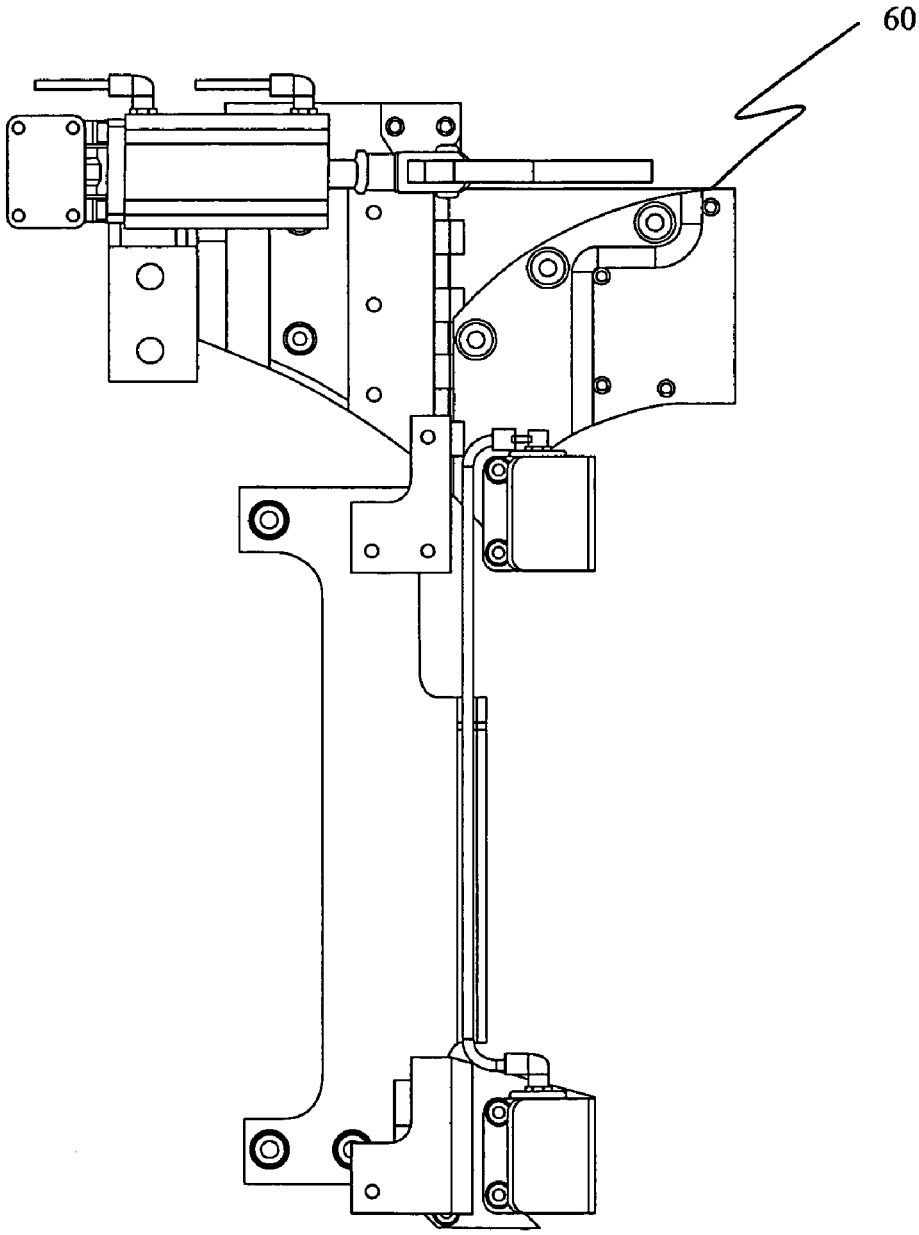
FIG. 19 is a side view of a guide track portion of the present invention on its mounting bracket in engaged position.

FIGS. 10 and 11 are a top and side view respectively of the moveable guide track portion in a disengaged position. In FIGS. 10 and 11 the piston 74 has been extended from cylinder 72. Through rotation at hinge points 78 and 82, the piston cylinder assembly extends to rotate bracket 76, which in turn rotates moveable guide track portion 60 to a disengaged position. The disengaged position is out of the plane of a bale loop.

As can be seen by comparing the engaged position in FIGS. 8 and 9 with the disengaged position in Figures in 10 and 11, the moveable guide track portion extends into a baling station space when in its engaged position, and retracts from the baling station space to an overall dimension that is sufficient to clear the end column (not shown) when the carriage 50 is withdrawn along the plane of the frame of the down press.

The down press 10 is comprised of a compression box 12. The compression hydraulics have been omitted for clarity. They are oriented above the compression box 12 and supported by center column 14 and end column 16.

FIGS. 12–19 are an assembly of three moveable guide track components 60 linked together as they would be on a three loop carriage. FIGS. 12, 14, 16 and 18 depict the moveable guide track portion 60 in its retracted, disengaged position. FIGS. 13, 15, 17 and 19 depict the moveable guide track portion 60 in its extended, engaged position.

The laterally displaceable guide track portions and their mounting and actuation of the present invention may be deployed in any number of bale loop assemblies. Although in the depicted embodiment, three are shown, any where from one to eight, of guide track assemblies, corresponding to the number of loops on a standard (6) or a universal (8) bale, or less, is within the scope of the present invention. The assembly shown in the FIGS. 12–13 appear in their three mount configuration in FIGS. 1–7.

Figure 20:
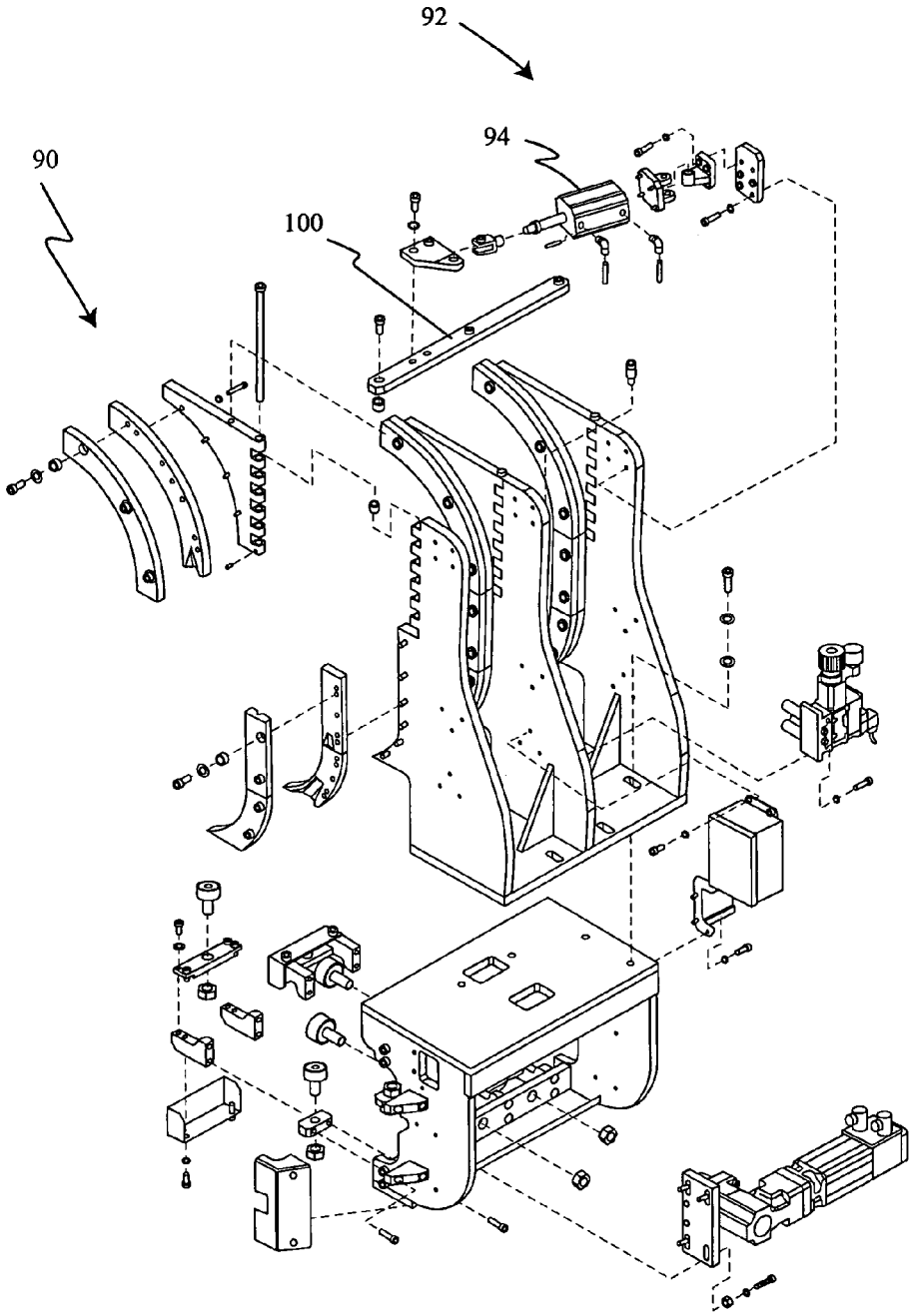
FIG. 20 is an exploded view of the receiver carriage of the present invention.
Figure 21:
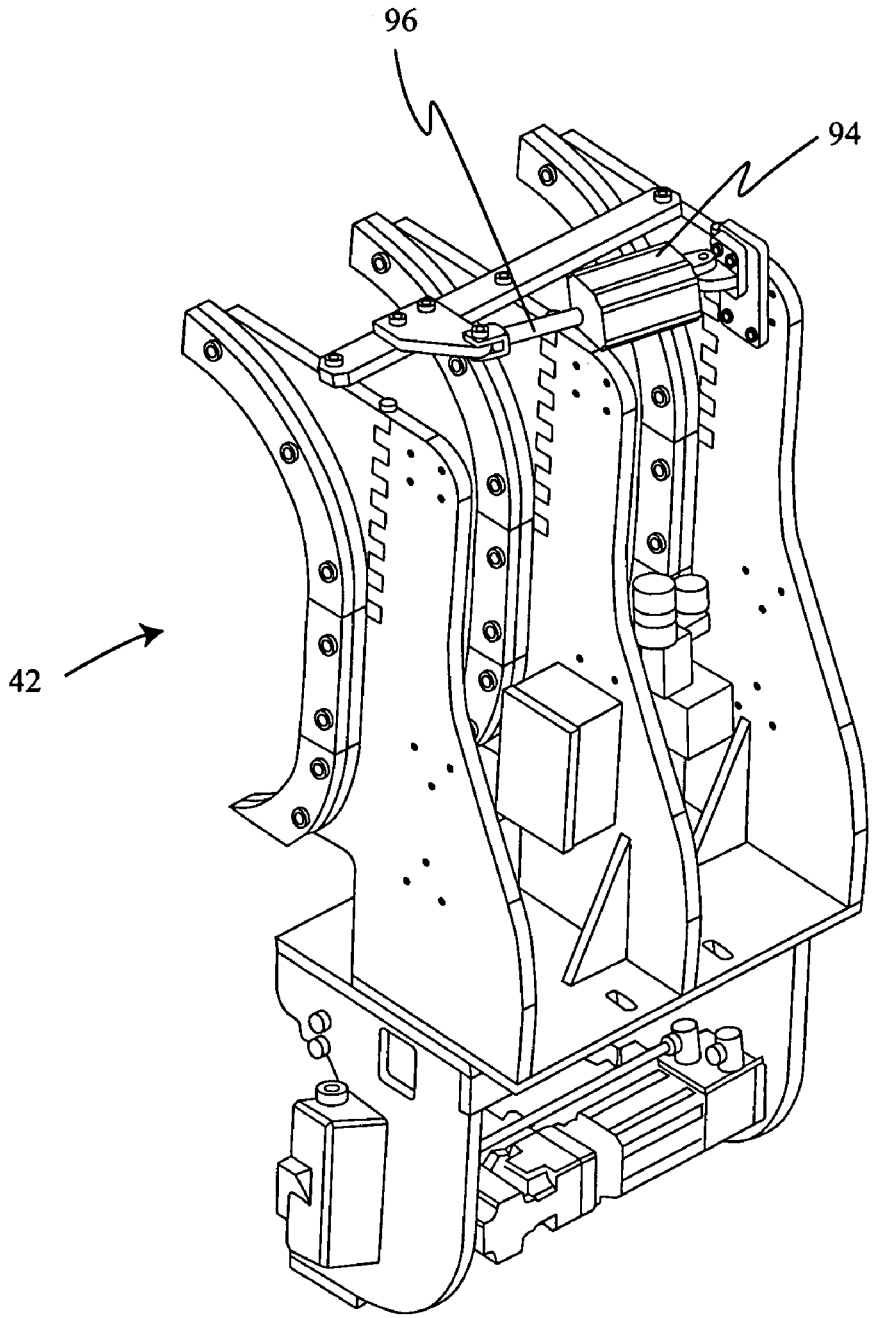
FIG. 21 is a front perspective view of the receiver carriage in the present invention.
Figure 22:
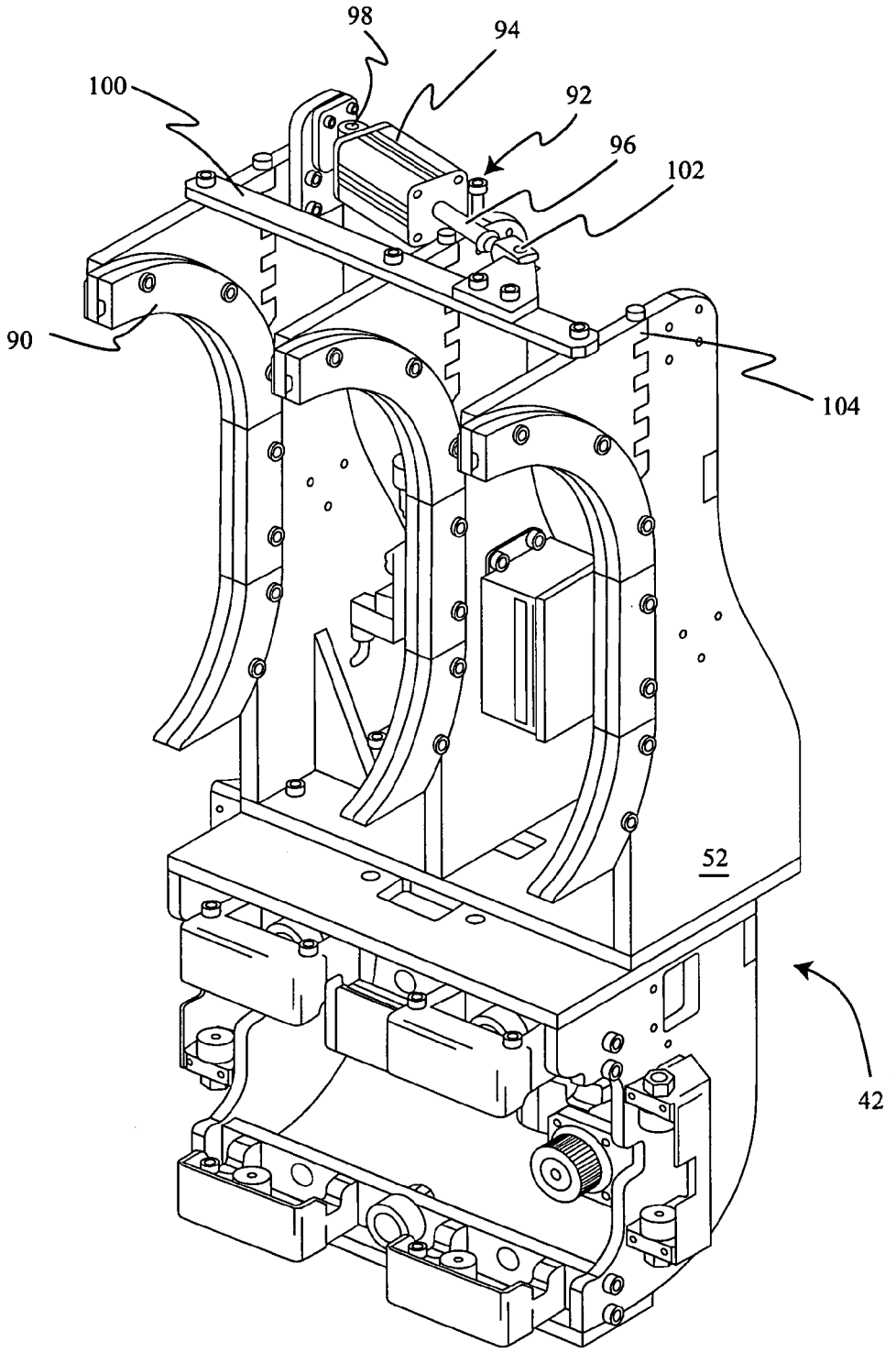
FIG. 22 is a rear perspective view of the receiver carriage in the present invention.

FIGS. 20, 21 and 22 depict the receiving side of the bale wire loop guide track, including the laterally displaceable receiving guide track portion 90. In these pictures, the receiving laterally displaceable guide track portion is shown in its extended position.

Receiving laterally displaceable guide tracks 90 are moved between their extended and retracted positions together, by piston and cylinder assembly 92, which is comprised of cylinder 94 and piston 96. This piston cylinder assembly 92 is pivotably mounted to a stationary carriage wall 52 at pivot point 98 and again pivotably mounted to tie bar 100 at pivot point 102. By retracting piston 96, tie bar 100 is moved laterally, and the receiving laterally displaceable guide track portions 90 may be moved from their extended, engaged position to a retracted, disengaged position. The receiving laterally displaceable guide track portions 90 pivot out of the plane of bale loop around their hinged mounting 104.

Similarly to the driver/knotter carriage 40, the receiving carriage 42 has components generally below the guide track components for mounting on a rail so that it may translate laterally between a withdrawn and an inserted position.

Figure 23:
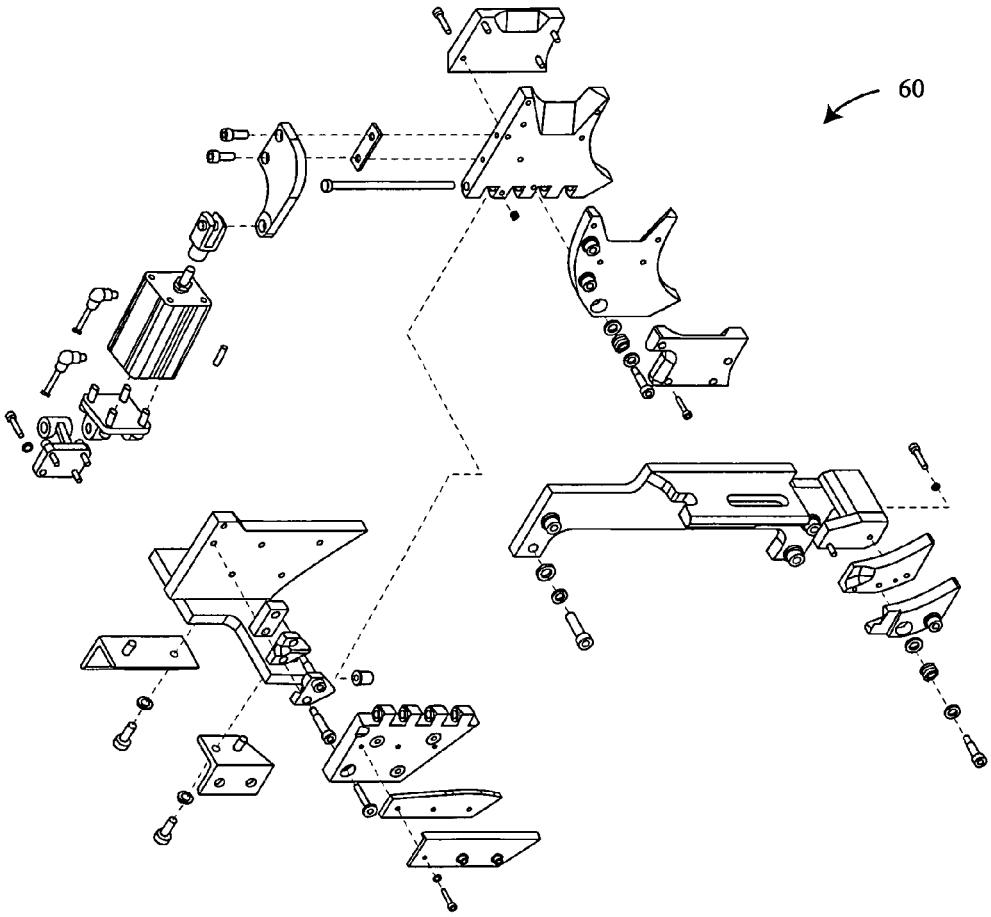
FIG. 23 is an exploded view of the moveable guide track portion and its mount.

FIG. 23 is an exploded view of a subassembly of a single moveable guide track portion 60 as mounted on a single vertical carriage wall 50.

In operation, the carriages 40 and 42 of the bale binding apparatus are in a withdrawn position, which is to say laterally displaced along rails 43 and 44 as seen in FIG. 1. A finished bale is removed or ejected from the baling station 20 of baling side 6 of the down packer 10. While this bale has been bound, the other compression box (not shown) has been loaded with loose bulk material at loading side 8 of down packer 10. With the carriages 40 and 42 laterally displaced a sufficient distance, the down packer central column 14 and compression boxes 12 rotate around the vertical axis of center pivot 18. The upper platen 22 has been withdrawn upwards to provide clearance for rotation of compression box 12. When the new compression box 12, now full of loose material, has arrived at the binding portion 6 of the down packer 10, the carriages 40 and 42 translate laterally and inwardly along rails 43 and 44 until they arrive at a first binding position engaged with the baling station 24.

In an embodiment having six bale loop guide tracks, knotters and drivers, there will only be one bale binding position. In the depicted embodiment, having three bale loop guide tracks, there will be two binding positions for the carriages 40 and 42.

During the withdrawal translation of the carriages 40 and 42, all of the guide track portions 60 and receiving guide track portions 90 are in their retracted, disengaged position as seen in FIGS. 2, 4, 6, 10 and 11.

The carriages 40 and 42 advance either sequentially or simultaneously with the compression of the bulk material through compression box 12 by vertically oriented and downward progression of the hydraulics (not shown), until they are in baling position. When the top platen 22 has extended completely downwards, the bulk material has been compressed and is maintained in its compression between lower platen 24 and upper platen 22. At this point, all moveable guide track portions 60 and all moveable receiving guide track portions 90 are swung around vertical pivots into their extended engaged positions. These are indexed to correspond to the matching lower guide tracks 30 and upper guide tracks 32 pre-positioned in the slots provided for them in the lower platens 20 and upper platens 22. Each guide track portion has an exit end and a receiving end that closely cooperates with a receiving end and an exit end of its adjacent guide tracks. At this point, there are three complete guide track loops, each in a separate and parallel plane. This plane is non-parallel with, and, in the depicted embodiment, perpendicular to the lateral axis of the rails on which the carriages 40 and 42 travel. The lateral direction of the rails corresponds to the long axis of the bale.

Wire or strap (wire in the depicted embodiment) is then driven in a complete circuit around the bale through all guide track portions. When a leading end of the bale wire arrives at the knotter attached to the carriage 40, a gripper, as is known, retains the leading edge, drive apparatuses are reversed in order to pull the wire out of guide track, also in a known fashion, so that the wire is drawn into contact with the bulk material being baled. Thereafter a knotter knots the leading and trailing ends of the wire. Thereafter the carriages 40 and 42 translate laterally from a first baling position engaging a first three set of guide tracks to a second baling position engaging the second three sets of guide tracks. The baling process repeats.

When six bale wires are in place and knotted, compressing pressure may be released. In the case of the down packer as depicted, pressure is released by raising the upper platen 22 with the vertical hydraulics. Either sequentially or simultaneously with a release of pressure, the carriages 40 and 42 may be laterally translated out of engagement with the baling station 24 and the rest of the down packer 10. However, in order to clear the width of end column 16, at this point the piston and cylinder assemblies 70 and 92 are activated in order to rotate the moveable guide track portion 60 and receiving moveable guide track portions 90 from their extended, engaged position to their retracted, disengaged position, which is preconfigured to provide a space wider than the width of end column 16. Thereafter, carriages 40 and 42 will translate laterally out of engagement with the baling station 20 and past end column 16 without any contact with any of the moveable guide track portion 60 or receiving moveable guide track portions 90. This process repeats.

In view of the foregoing, it will be seen that the several advantages of the invention are achieved and attained.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A laterally displaceable guide track for a bale binding apparatus comprising:

a carriage;

a moveable guide track portion hingedly mounted in said carriage, said moveable guide track portion having an engaged position and a disengaged position, said engaged position being aligned with at least one other guide track portion to define a bale loop plane, and said disengaged position being out of said bale loop plane;

a fixed guide track portion mounted on said carriage, said fixed guide track portion being on said bale loop plane; and a mount of said moveable guide track portion on said carriage, said mount allowing said moveable guide track portion to be moved between said engaged position and said disengaged position.

2. The guide track of claim 1 wherein said mount is a hinge.

3. The guide track of claim 2 wherein said hinge is substantially vertical.

4. The guide track of claim 1 further comprising a piston and cylinder, one of said piston or said cylinder being hingedly attached to said carriage, and the other of said piston or said cylinder being hingedly attached to said moveable guide track portion, such that said piston and cylinder mediate travel of said moveable guide track portion between said engaged position and said disengaged position.

5. The guide track of claim 1 wherein three moveable guide track portions are mounted on said carriage.

6. The guide track of claim 1 wherein said guide track portions are each comprised of two longitudinal halves, said longitudinal halves being spring biased together, and said longitudinal halves forming between them a channel dimensioned to guide an advancing bale wire.

7. The guide track of claim 1 further comprising:

a second carriage;

a second moveable guide track portion, said second moveable guide track portion having an engaged position and a disengaged position, said engaged position of said second moveable guide track portion being aligned with the at least one other guide track portion to define said bale loop plane and said disengaged position being out of said bale loop plane;

a second mount of said second moveable guide track portion on said second carriage, said second mount allowing said second moveable guide track portion to be moved between said engaged position and said disengaged position.

8. The guide track of claim 7 further comprising:

a lower guide track portion dimensioned to be disposed in operative cooperation with a lower platen of a bulk material press;

an upper guide track portion, being dimensioned to be disposed in operative cooperation with an upper platen of a bulk material press;

wherein said moveable guide track portion, said fixed guide track portion, said second moveable guide track portion, said lower guide track portion and said upper guide track portion form a bale loop, said bale loop circumscribing a volume of bulk material and defining said bale loop plane.

9. The guide track of claim 7 further comprising:

a second fixed guide track portion mounted on said second carriage in alignment with said second movable guide track portion.

10. The guide track of claim 1 wherein said carriage has a wire feed device and a wire knotter mounted thereon, said wire feed device and said knotter being disposed to operatively cooperate with said moveable guide track portion and said fixed guide track portion for baling.

11. The guide track of claim 1 wherein said engaged position of said moveable guide track portion is disposed to closely cooperate with a guide track portion disposed within a platen.

12. The guide track of claim 1 wherein said engaged position extends into a baling station space.

13. The guide track of claim 1 wherein said disengaged position is dimensioned to clear an end column of a bulk material press.

14. The guide track of claim 4 wherein said piston and cylinder are pneumatic.

15. The guide track of claim 1 wherein said bale loop plane is substantially perpendicular to a long axis of a bale.

16. The guide track of claim 1 wherein a carriage translates on a rail, said rail being nonparallel with said bale loop plane.

17. A bale binder comprising:

a first carriage disposed to translate laterally along a rail between a baling station and a position removed from said baling station;

at least two moveable guide track portions each being hingedly mounted on said carriage and each of said moveable guide track portions being aligned with a separate bale loop plane when said first carriage is at said baling station;

each of said moveable guide track portions having an engaged position and a disengaged position, said engaged position being on one of said bale loop planes and said disengaged position being out of said bale loop plane and beyond a clearance dimension sufficient for said first carriage to translate past a frame element of a press.

18. The bale binder of claim 17 further comprising a wire feed apparatus and a knotter, said wire feed apparatus and said knotter being mounted on said first carriage to operatively cooperate with said guide track portion.

19. The bale binder of claim 17 further comprising a second carriage.

20. The bale binder of claim 19 wherein said second carriage further comprises at least two second moveable guide track portions, each being hingedly mounted on said second carriage, and each of said second moveable guide track portions being aligned with separate bale loop planes when said second carriage is at said baling station.

21. The bale binder of claim 19 wherein said first carriage translates along said rail and said second carriage translates along a second rail.

22. The bale binder of claim 17 wherein said first carriage translates laterally, said lateral translation being parallel to a radius of a circle defined by the rotation of a compression box of a bulk material press.

23. A bale binder comprising:

a drive carriage, at least two moveable guide track portions, each hingedly mounted on said carriage and each of said at least two moveable guide track portions being moveable between an extended position and a retracted position;

at least two actuators, each of said actuators being mounted on said drive carriage and operatively engaged with each of said at least two moveable guide track portions such that said at least two actuators mediate travel of said at least two moveable guide track portions between said extended position and said retracted position;

at least two wire feed devices, each of said wire feed devices being mounted on said carriage and being disposed to operatively cooperate with said moveable guide track portions when said moveable guide track portions are in said extended position;

at least two knotters, each of said knotters being mounted on said carriage and each of said knotters being disposed to operatively cooperate with each of said at least two removable guide track portions when said moveable guide track portions are in said extended position;

a return carriage;

at least two moveable return guide track portions, each moveable return guide track portion being hingedly mounted on said return carriage and each of said return moveable guide track portions having an extended position and a retracted position;

at least two fixed return guide track portions, each of said fixed return guide track portions being mounted on said return carriage;

at least one actuator, said actuator being mounted on said return carriage and being operatively engaged with each of said of least two return moveable guide track portions such that said actuator mediates travel of said at least two return moveable guide track portions between said extended and said retracted positions;

a drive carriage rail; and a return carriage rail, each of said drive carriage and said return carriage being disposed to translate along said rails into and away from a baling station in a direction non-perpendicular to a long axis of a bale being bound;

wherein said extended positions of said at least two moveable guide track portions and said at least two return moveable guide track portions operatively cooperate with at least two upper guide track portions and at least two lower guide track portions to complete a guide track loop around a volume of bulk material, and wherein said retracted positions of said at least two moveable guide track portions and said at least two return moveable guide track portions are dimensioned to clear a bulk material press when said carriages are translated away from said baling station.

* * * * *